US012571212B2

(12) United States Patent
Smeding et al.

(10) Patent No.: US 12,571,212 B2
(45) Date of Patent: Mar. 10, 2026

(54) TRUSS ELEMENT, LADDER ELEMENT, COUPLING ELEMENT AND TRUSS SYSTEM

(71) Applicant: SIXTY82 B.V., Drachten (NL)

(72) Inventors: Fokke Smeding, Drachten (NL); Ralph Beukema, Drachten (NL); Marc Hendriks, Drachten (NL)

(73) Assignee: SIXTY82 B.V., Drachten (NL)

( * ) Notice: Subject to any disclaimer, the term of this patent is extended or adjusted under 35 U.S.C. 154(b) by 428 days.

(21) Appl. No.: 18/020,789

(22) PCT Filed: Aug. 9, 2021

(86) PCT No.: PCT/IB2021/057318

§ 371 (c)(1),
(2) Date: Feb. 10, 2023

(87) PCT Pub. No.: WO2022/034470

PCT Pub. Date: Feb. 17, 2022

(65) Prior Publication Data

US 2023/0304289 A1 Sep. 28, 2023

(30) Foreign Application Priority Data

Aug. 13, 2020 (NL) ..... 2026265

(51) Int. Cl.
*E04C 3/08* (2006.01)
*E04C 3/04* (2006.01)

(52) U.S. Cl.
CPC ..... *E04C 3/08* (2013.01); *E04C 2003/0413* (2013.01); *E04C 2003/0465* (2013.01);
(Continued)

(58) Field of Classification Search
CPC ..... E04C 3/08; E04C 2003/0413; E04C 2003/0465; E04C 2003/0469; E04C 2003/0486
See application file for complete search history.

(56) References Cited

U.S. PATENT DOCUMENTS 2,582,385 A 1/1952 Knudsen
5,003,748 A * 4/1991 Carr ..... E04B 1/19 403/219

(Continued)

FOREIGN PATENT DOCUMENTS

CN 101 824 905 B 4/2011
GB 1 223 905 A 3/1971

(Continued)

OTHER PUBLICATIONS

International Search Report and Written Opinion corresponding to International Application No. PCT/IB2021/057318 dated Oct. 13, 2021.

*Primary Examiner* — Babajide A Demuren
(74) *Attorney, Agent, or Firm* — Jenkins, Taylor & Hunt, P.A.

(57) ABSTRACT

A truss system comprises at least one truss element of mutually parallel tube bodies (11, 12) which are mutually connected in a ladder element (10) by a system of shores (15, 16). The tube bodies (11, 12) are provided at opposite outer ends with coupling means (13) for a force-transmitting coupling to a further truss element. Ladder elements (10) are connected releasably to each other by form-stiff coupling elements (30).

20 Claims, 7 Drawing Sheets

(52) U.S. Cl.
CPC ..... *E04C 2003/0469* (2013.01); *E04C 2003/0486* (2013.01)

(56) References Cited

U.S. PATENT DOCUMENTS

| | | | | |
|---|---|---|---|---|
| 5,437,136 | A | 8/1995 | Triebel | |
| 6,079,178 | A * | 6/2000 | Fisher | E04C 3/291 52/690 |
| 6,799,406 | B2 * | 10/2004 | Gosselin | B21D 47/04 52/696 |
| 11,333,297 | B2 * | 5/2022 | Bruyninckx | E04C 3/08 |
| 2010/0064624 | A1 | 3/2010 | Dodd | |

FOREIGN PATENT DOCUMENTS

| | | |
|---|---|---|
| WO | WO 96/18784 | 6/1996 |
| WO | WO 96/27060 A1 | 9/1996 |

* cited by examiner

TRUSS ELEMENT, LADDER ELEMENT, COUPLING ELEMENT AND TRUSS SYSTEM

CROSS REFERENCE TO RELATED APPLICATIONS

This application is a national stage filing of PCT International Application No. PCT/IB2021/057318, filed Aug. 9, 2021, which is based on and claims priority to Netherlands Patent Application No. 2026265, filed Aug. 13, 2020.

The present invention relates to a truss element comprising at least a first and a second ladder element of mutually parallel tube bodies extending in a longitudinal direction, the tube bodies of which are mutually connected by a system of shores and are provided at opposite outer ends with coupling means for a releasable, force-transmitting coupling to a further truss element.

Trusses usually comprise a metal framework, mainly of steel or aluminium, of tube bodies mutually connected by shores. Such frameworks are applied on large scale, for instance for audiovisual and stage construction applications, for the purpose of constructing a lattice, whereby a span can for instance be bridged and/or columns and pillars can be erected. This is usually a system of a number of mutually connected truss elements which are mutually rigidly coupled by means of releasable connecting means at their outer ends. The thus realized lattice serves for instance as a structure from which a light fitting or loudspeaker can be suspended and/or on which a covering, such as a roof or podium, can be supported.

Although the releasable coupling of the truss elements enables such a truss system to be utilized particularly flexibly, both for short-term and long-term use, the diversity of structures which can be realized thereby also requires a great diversity of truss elements, both in respect of form and function, and of dimensions. For this purpose these must all be kept in stock at least for the most part. This not only requires a considerable investment, but also considerable storage space. This latter is limited not only to storage for stock, but also requires more space during transport of truss systems which, by their nature, are often used temporarily at different locations.

With a view to a limitation of the necessary space during storage and transport, it is known from American patent application US 2010/0064624 and International patent application WO 96/18784 to give a truss element a collapsible form. For this purpose the connecting elements which mutually connect the two ladder elements take a pivoting form so that the ladder elements can be folded up when not in use and can be moved apart for use. Although a considerable saving of necessary space can be achieved thereby when not in use, the collapsible construction is clearly detrimental to the stiffness and strength of a truss system constructed therefrom.

The present invention has for its object, among others, to provide a truss system which obviates these drawbacks to at least significant extent.

In order to achieve the stated object a truss element of the type described in the preamble has for this purpose the feature according to the invention that the ladder elements are mutually connected in transverse direction by means of a number of form-stiff coupling elements which impart a shape to the truss element, that the ladder elements comprise connecting means for a releasable connection to a flank of a coupling element, and that the ladder elements are connected rigidly to each other via the coupling elements by means of the connecting means.

A truss system to be constructed with such truss elements is thus not only detachable to the level of the truss elements, the truss elements themselves can furthermore also be taken apart to the level of mutually connected ladder elements, referred to hereinafter as ladders for short, and coupling elements which function here as connecting frames and which provide for a cross-connection in the truss element. This modular setup of the truss elements themselves provides a great deal of flexibility in the choice of a shape, function and/or dimension to be realized on site, whereby it is not necessary to keep all manner of individual and separate trusses in stock for this purpose. Once taken apart, the truss element can moreover be stored particularly compactly so that considerably less storage space or loading space is taken up thereby. In order to avoid parts protruding from the ladder element, which could otherwise be detrimental to the packing density thereof and could pose an injury risk, as far as possible here a preferred embodiment of the truss element has the feature according to the invention that the connecting means lie wholly between the tube bodies of the ladder element in question.

The shape of the truss element is at least mainly imparted by the coupling elements. In this respect a preferred embodiment of the truss element according to the invention has the feature that the coupling elements impart an at least substantially polygonal cross-section with opposite polygon sides to the truss element, particularly a polygonal cross-section from a group comprising a triangle, a square, a rectangle and a trapezium, and that the coupling elements comprise complementary connecting means on opposite polygon sides of the polygonal cross-section for the releasable connection to the connecting means of the adjacent ladder element, particularly in the form of drilled holes for receiving screw members for a screw connection to a ladder element.

A particular embodiment of truss system to be constructed therefrom has the feature here that the polygonal cross-section represents a polygon from a group comprising a triangle, a square, a rectangle and a trapezium. By coupling ladder elements (ladders) via such coupling elements a great diversity of shapes can thus be realized from a limited number of components, while maintaining stiffness and strength.

Owing to the shores inside the ladder elements (ladders) an adequate bending stiffness and loadability is provided in the plane thereof, so that buckling is avoided. To likewise provide additional stiffness and strength between the ladder elements a further preferred embodiment of the truss element according to the invention has the feature that at least a part of the coupling elements between the ladder elements are connected releasably in the longitudinal direction via one or more strengthening devices. The strengthening devices arranged in the truss element provide between the coupling elements a bond in the lattice which will eventually form the truss element, and thereby additional strength and stiffness.

For the purpose of a solid and practical connection between the strengthening devices and the coupling elements a further particular embodiment of the truss element according to the invention has the feature that the strengthening devices each comprise at least one diagonal, particularly a shoring cross, between a set of opposite transverse ribs and that outermost transverse ribs are connected releasably to an adjacent coupling element, and are particularly fixed thereon by means of a releasable screw connection.

A further particular embodiment of the truss element according to the invention has the feature here that the outermost transverse ribs and the coupling elements comprise in corresponding manner an axial guide and a guide body sliding therein, which guide body is locked in the guide in the longitudinal direction, and that provided between the guide and the guide body locked therein are releasable connecting means which fix the guide body in the guide, particularly a bolt-nut connection by means of mutually registering drilled holes provided for this purpose in the guide and the guide body. A strengthening device thus slides on both sides into the locking guide of each of the adjacent coupling elements and enters into a connection therewith.

The truss element according to the invention is here further particularly characterized in that the guide body comprises a strip part and the guide an axial receiving cavity in which the strip part can be fittingly received. Such strip parts can for instance be formed on the strengthening device and be provided in the guide with drilled holes for receiving screw members for a fixing screw connection between, in each case, a coupling element and a strengthening device. Owing to the screw members, such as for instance screw bolts and/or nuts, any remaining clearance between the strengthening devices and connecting frames can likewise be removed, and additional stiffness so provided.

With a view to flexibility and uniformity, a further preferred embodiment of the truss element according to the invention has the feature that in the longitudinal direction the shores are in each case flanked on either side by a releasable connection to a coupling element. Inside a ladder element, the shores thus in each case alternate with connections to the coupling elements (connecting frames) in longitudinal direction. By making use of a fixed pitch here uniformity is provided, which, besides resulting in a uniform force distribution, furthermore results in a standardization of the applied ladder elements. The coupling elements can here in each case be provided between each set of successive shores, and are thereby repeatedly present or placeable at an optionally fixed pitch. Eventually, this also results in a truss system with a uniform appearance which is constructed therefrom, which is also more attractive from an aesthetic viewpoint.

In a further particular embodiment the truss system according to the invention has the feature that the connecting means inside each of the ladder elements in each case comprise alternately with the shores a set of ribs which leave a mutual recess in which a flank of a coupling device can be received and releasably connected. The coupling elements are thus received with their flanks between the ribs on either side, and connected thereto. More specifically, the truss element according to the invention has the feature for this purpose that the ribs and the coupling element are provided in corresponding manner with at least one screw cavity and a screw member fitting therein for the purpose of a releasable connection. Such an enclosure and connection of the flanks of the coupling elements between the ribs produces a particularly solid and torsion-stiff structure.

A particularly versatile and flexible embodiment of the truss element according to the invention has the feature that the coupling elements each comprise a monolithic body, particularly an extruded body, more particularly a metal body. Use can be made here of an extruded base body with an initial shape from which the coupling element was removed as desired along a desired contour, for instance by machining, (laser) cutting or sawing. This provides a great degree of flexibility in respect of the final contour (shape) of the coupling elements, and thereby of the cross-section imparted thereby of the truss element to be formed thereby. Drilled holes, screw cavities or other coupling means can be provided in the extruded body for the purpose of the releasable connection to the ladder elements.

The truss element according to the invention is assembled from a set of ladder elements and a suitable number of coupling elements therebetween, wherein these latter will impart the final form to the truss element. The invention therefore also relates to such a ladder element for application in the above described truss element, comprising a set of mutually parallel tube bodies which extend in a longitudinal direction and are mutually connected by a set of shores, wherein coupling means are provided on opposite free outer ends thereof for the purpose of a releasable, force-transmitting coupling to a further truss element, with the feature that connecting means are provided therein for the purpose of a releasable connection to a flank of a coupling element which is able and configured to bring about and maintain a releasable connection in transverse direction to a spatially separated further ladder element which likewise extends in the longitudinal direction.

The invention further relates to a coupling element for application with one or more of such ladder elements in such a truss element, which coupling element comprises a form-stiff, monolithic metal body which is particularly obtained by extrusion and which imparts a polygonal cross-section to the truss element, and which is provided on opposite polygon sides with connecting means for a releasable connection to a ladder element of the truss element, particularly in the form of drilled holes for receiving screw members for a screw connection to a coupling device. A preferred embodiment has the feature here that the coupling element was removed from a larger monolithic body, particularly an extruded body, along a desired contour.

The invention further relates to a truss system which is constructed using one or more of the above described truss elements, and will now be further elucidated on the basis of a number of exemplary embodiments and an accompanying drawing, which will also show further aspects of the invention. In the drawing.

It is noted here that the drawings are purely schematic and not always drawn to (the same) scale. Some dimensions in particular may be exaggerated to greater or lesser extent for the sake of clarity. Corresponding parts are generally designated in the figures with the same reference numeral.

Figure 1A:
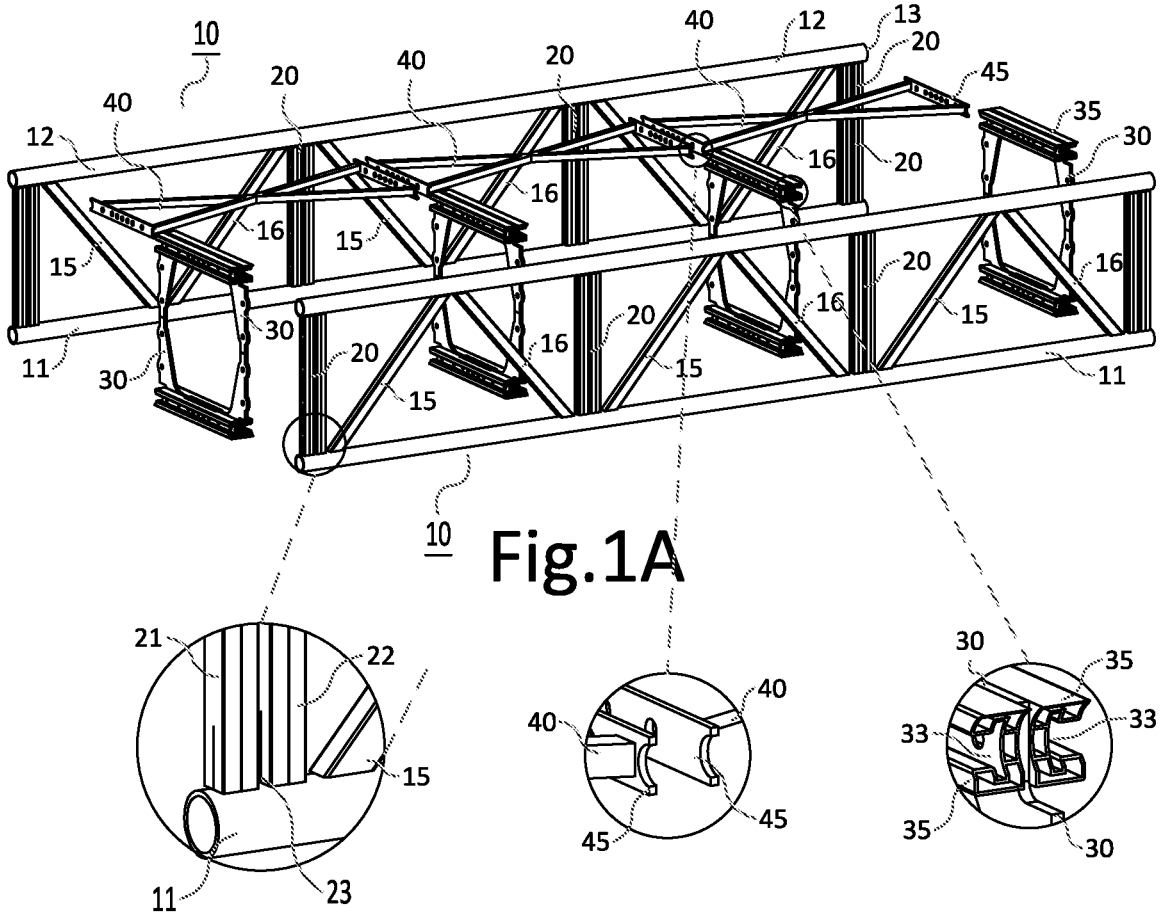
FIG. 1A shows an exploded view of a first embodiment of a truss element according to the invention.
Figure 2A:
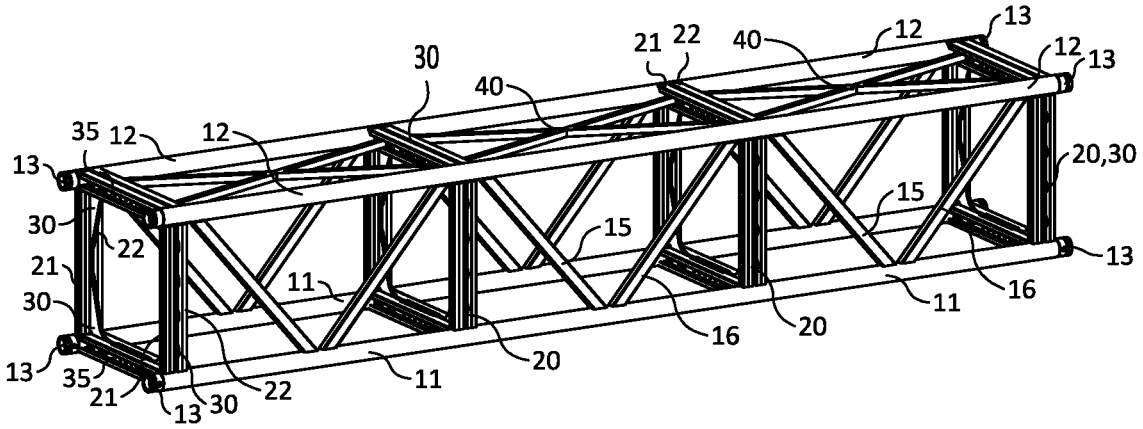
FIG. 2A shows a perspective view of the truss element of FIG. 1A in assembled state.

The truss element of FIGS. 1A and 2A comprises a first set of tube bodies 11, 12 which are mutually connected by a system of shores 15, 16 so as to form a first ladder element together. The truss element additionally comprises an identical second set of tube bodies 11, 12 which are likewise mutually connected by shores 15, 16 and form a second ladder element (10). Both the tube bodies and the shores are manufactured from aluminium but, just as for the other parts of the truss element, a different material can also be used therefor, particularly optionally preserved steel or a fibre-reinforced plastic. The shores 15, 16 are for instance durably connected to the tube bodies 11, 12 by means of welding, bolts or gluing.

The shores 15, 16 of each ladder element 10 alternate in pairs with sets of ribs 21, 22. The ribs 21, 22 maintain a mutual clearance 23, see also the enlargement on the left in FIG. 1A, and provide not only structural stiffness and strength to the ladders 10, but moreover connecting means 20 for a releasable connection to intermediate coupling elements 30. For the ribs 21, 22 use can be made of solid parts or hollow tubular parts of aluminium which, just as shores 15, 16, are connected non-releasably, at least durably, to the tube bodies 11, 12 by gluing, bolts or welding. For the purpose of said releasable connection the ribs 21, 22 are provided with a series of mutually registering drilled holes for receiving screw members for a screw (cavity) connection, a bolt-nut connection or similar coupling. Such a set of ribs 21, 22 is also situated preceding and following the system of shores 15, 16, as can be seen in FIGS. 1A and 2A. Instead of a set of individual ribs 21, 22, use can otherwise optionally also be made of a composed or assembled (extruded) stand-alone device with the recess 23 therein.

Figure 1B:
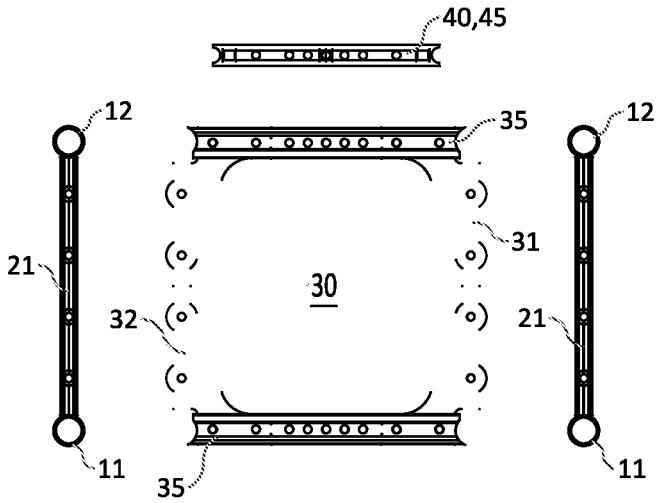
FIG. 1B shows the constituent parts of the truss element of FIG. 1 in a frontal view.
Figure 2B:
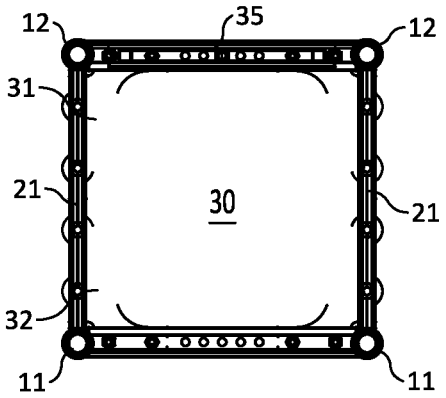
FIG. 2B shows a front view of the truss element of FIG. 1A in assembled state.

The ribs 21, 22 serve to connect to successive coupling elements 30 which are received between the two ladder elements 10 and which mutually connect the ladder elements. In this example, each connection is in each case a set of form-stiff coupling elements 31, 32 which are applied in pairs and mirrored relative to each other, see also FIGS. 1B and 2B. It is instead otherwise also possible to opt in each case for a single, undivided coupling element. The coupling elements 31, 32 are formed from aluminium, although a different rigid material can also be used for this purpose, such as for instance optionally preserved steel or a fibre-reinforced plastic.

The coupling elements 30 comprises as their base a plate body or extruded body with flanks 31, 32 on either side, these being directed toward the two ladder elements 10 to be connected and provided with drilled holes. These flanks fall into the recesses 23 between the ribs 21, 22 of ladders 10, wherein the drilled holes in the flanks register with the drilled holes in these ribs 21, 22. Screw holes in which an internal screw thread is provided can here be provided in ribs 21, 22 for the purpose of a direct screw connection to a fitting screw bolt. Slightly oversized drilled holes can also be applied for receiving and passage of a fitting bolt of a bolt-nut connection, for instance inside a chamber provided for this purpose in ladder element 10 and having a nut situated therein. By thus coupling the ribs 21, 22 and the coupling elements 30 to each other by means of a large number of bolts and nuts the ladder elements 10 can be assembled into the truss element shown in perspective view in FIG. 2A and in front view in FIG. 2B. The polygonal, particularly square, cross-section of this truss element is determined and defined wholly by the contour of the form-stiff coupling elements 30 applied therein.

Together with ribs 21, 22, the shores 15, 16 impart stiffness and bending strength to ladder elements 10. In order to provide stiffness and strength in the truss element between the ladders 10 as well, so that the truss element also remains loadable transversely of the plane of ladder elements 10, strengthening devices 40 which mutually connect and bond the coupling elements in longitudinal direction can be applied between the coupling elements 30. Although one diagonal can suffice as trestle in strengthening device 40, a shoring cross is preferably formed therein, as it is here, from a set of diagonals 41, 42. At the end surfaces the strengthening devices end in each case with a strip part 45 which is formed in transverse direction on cross 41, 42. If desired, the cross 41, 42 of strengthening devices 40 can otherwise also be coupled directly to coupling elements 30 by means of for instance bolts and nuts. The coupling elements 30 each comprise on either side a complementary axial guide 35 in which such a strip part 45 of the adjacent strengthening devices 40 is slidably received, see also the two enlargements on the right in FIG. 1A. Because of the applied profiling of the guides 35, these lock the strip parts 45 therein so that a mutual bond is thereby already created therein between coupling elements 30 and strengthening devices 40. Provided both in guides 35 and in strip parts 45 is a series of drilled holes for receiving screw bolts with nuts, whereby this bond is additionally strengthened and any clearance is removed.

The truss element shown in FIG. 2A can thus be realized, wherein such strengthening devices 40 are only shown in an upper side for purposes of illustration, but an underside can also be provided therewith in the same way. The result is a completely stiff and clearance-free whole which can be utilized as fully-fledged truss element. Applied at the free outer ends are truss couplings 13 which, if desired, can be adapted to the couplings in an existing truss system in order to allow the shown truss element to fit therein and connect thereto. If desired, the assembled truss element can be completely dismantled again into the constituent parts shown in FIGS. 1A and 1B, which can be stacked in compact manner and then take up a relatively small volume. It is noted here for the sake of completeness that the bolts and nuts used are not always shown in the figures for the sake of clarity, since they are assumed sufficiently known to a person with ordinary skill in the art.

Figure 3A:
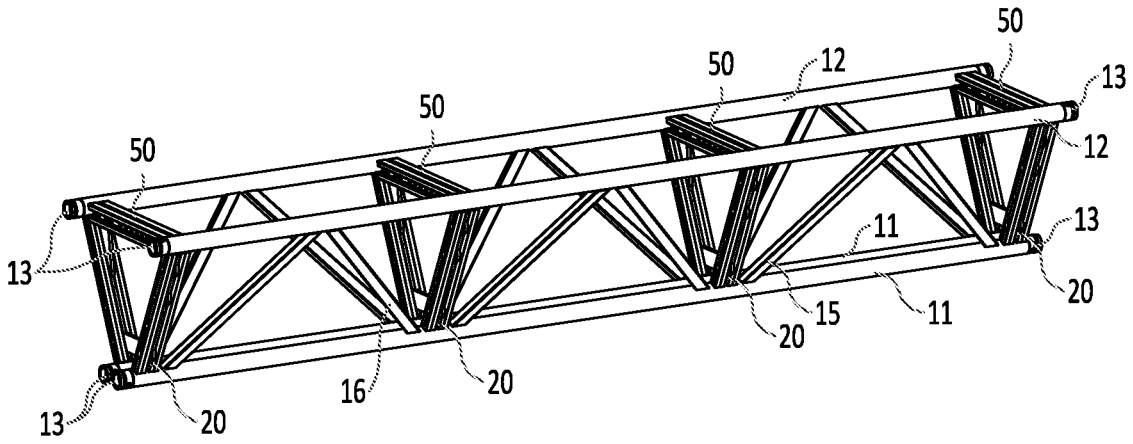
FIG. 3A shows a perspective view of the truss element of a second embodiment of a truss element according to the invention.
Figure 3B:
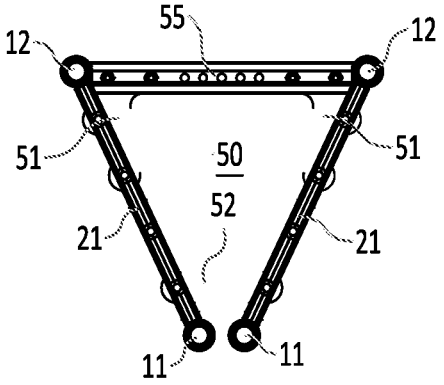
FIG. 3B shows a front view of the truss element of FIG. 3A.

Besides the compact storage, the modular truss element according to the invention moreover provides a high degree of flexibility and freedom of form. This will be illustrated further with reference to FIGS. 3A-7C, without the intention of providing a limited list thereby. Use is in each case made here of a set of ladder elements 10 which are each individually constructed, as shown in FIG. 1, from a set of tubular bodies 11, 12 which are mutually connected by a system of shores 15, 16, or another mutual cross-connection, and ribs 21, 22. It can be given a different shape in each case by adapting the coupling elements to be applied. In the truss element of FIGS. 3A and 3B use is thus made of coupling elements 51, 52 which impart thereto a triangular cross-sectional shape. On opposite triangle sides the coupling elements 51, 52 protrude with their flanks into the recesses 23 between the ribs 21, 22 of ladder elements 10. Provided in the flanks are drilled holes, corresponding with the drilled holes in the ribs 21, 22, for the described firm bolt-nut connection to the ladder element 10, so that the triangular truss element shown in perspective view in FIG. 3A can be realized using roughly the same components as the truss element of FIGS. 1A and 2A, albeit that different form-stiff coupling elements 51, 52 were applied therein. A first coupling element 51 of the two coupling elements 51, 52 can here once again be provided with a guide 55 on the front and rear side for connection to a strengthening device 40, as described above. The other coupling element 52 is strip-like and defines the apex angle of the triangle. A truss with sufficient stiffness and strength can thus be formed with the two ladder elements 10.

Figure 4A:
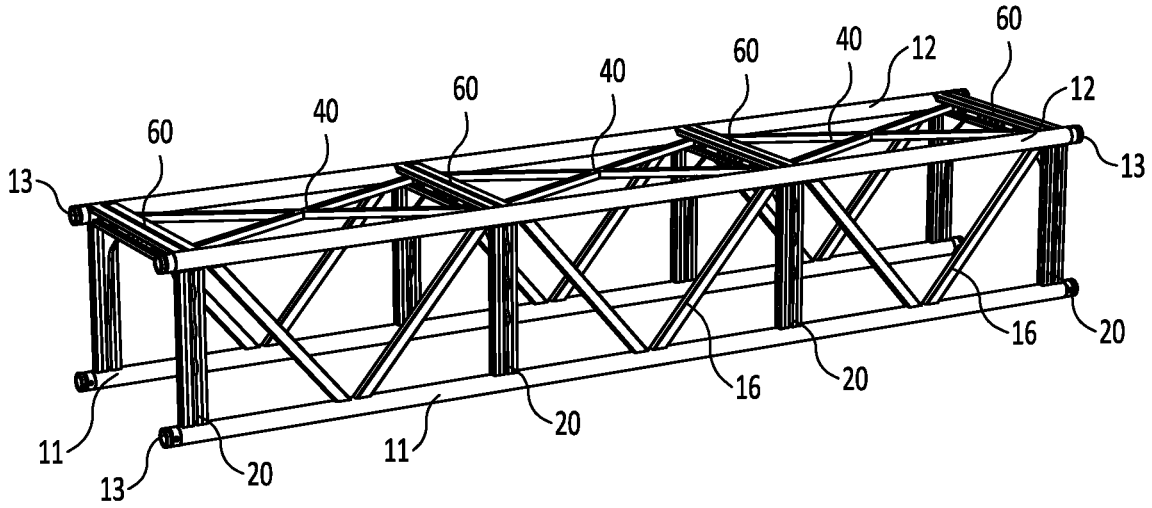
FIG. 4A shows a perspective view of the truss element of a third embodiment of a truss element according to the invention.
Figure 4B:
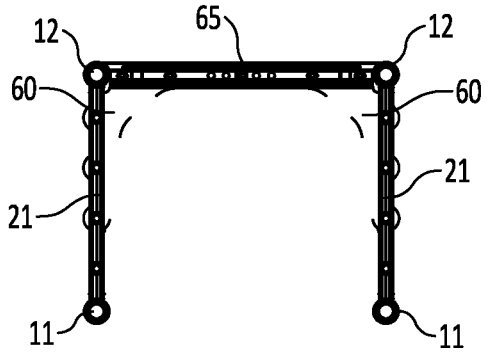
FIG. 4B shows a front view of the truss element of FIG. 4A.

In FIGS. 4A and 4B a U-shaped truss is realized in similar manner. This shape is imparted by U-shaped coupling elements 60 taking this form. In this case the coupling elements also comprise as a base a plate part 60 or extruded body which protrudes with opposite flanks into the recess 23 between the ribs 21, 22 of a ladder element 10 and can be secured therein with bolts and nuts as described above. The coupling elements 60 here also comprise on the front and rear side a guide 65 with drilled holes for slidably receiving a distal strip part 45 of a strengthening device 40 as shown in the perspective view. The shores of this strengthening device 40 here also provide the truss element with additional strength and stiffness between the two ladder elements 10.

Figure 5A:
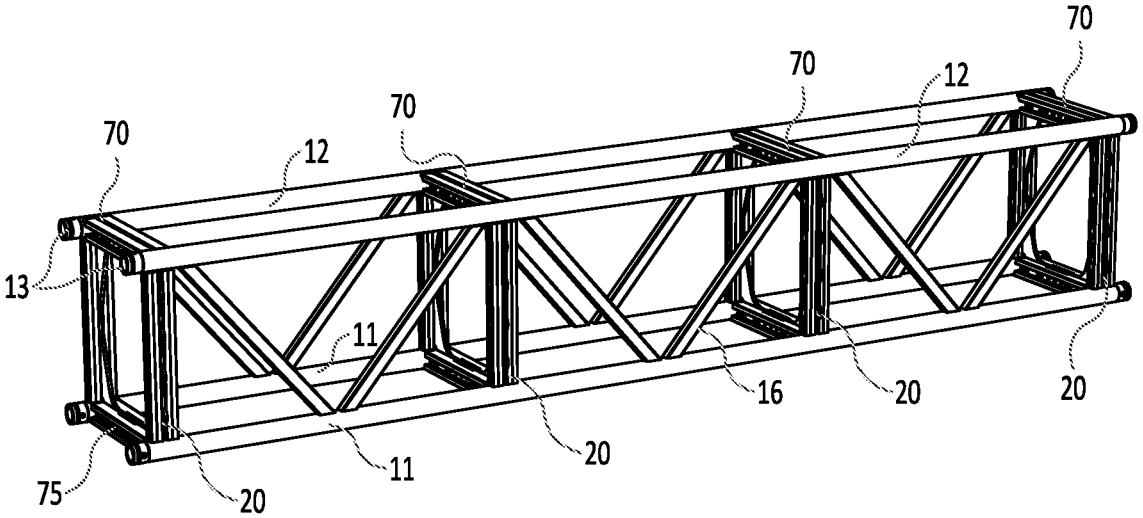
FIG. 5A shows a perspective view of the truss element of a fourth embodiment of a truss element according to the invention.
Figure 5B:
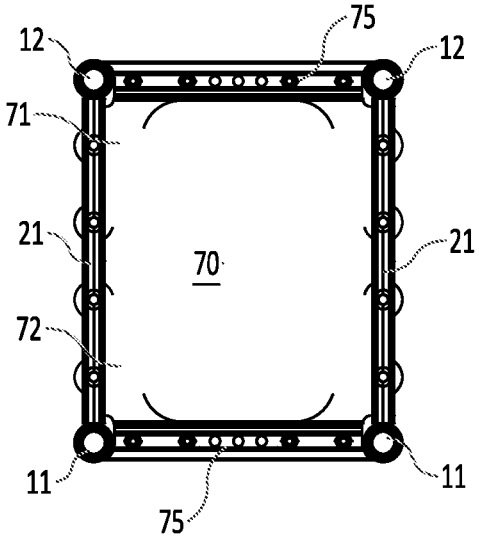
FIG. 5B shows a front view of the truss element of FIG. 5A.

A rectangular variant of the truss element according to the invention is shown in FIGS. 5A and 5B. The two ladder elements 10 are in this case releasably connected, with interposing of the coupling elements 70 received therebetween, by means of bolts and nuts whereby the components are coupled to each other. A dimensioning of the coupling elements 70 is chosen here such that the resulting truss element has opposite long rectangle sides between opposite short(er) sides. As in the square embodiment of FIGS. 1A and 2A, divisible coupling elements 70 from two elements 71, 72 which are mirrored relative to each other are also opted for here from a practical viewpoint. A single connecting frame, for instance a plate part or extruded body, which combines the two parts 71, 72 can instead also be applied. The coupling elements comprise guides 75 in which support devices 40 can if desired be received in longitudinal direction for additional stiffness on the short sides, in the manner already described above.

Figure 6A:
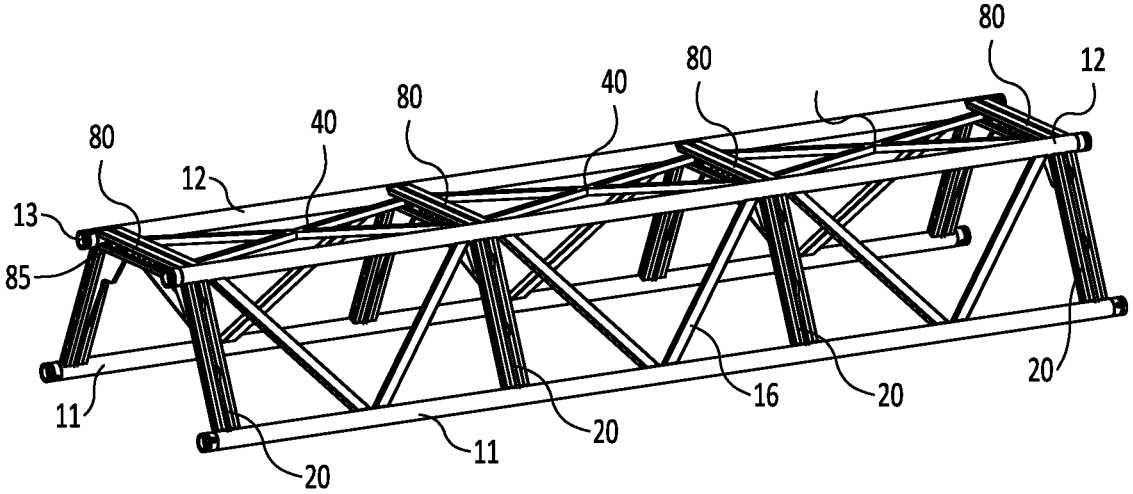
FIG. 6A shows a perspective view of the truss element of a fifth embodiment of a truss element according to the invention.
Figure 6B:
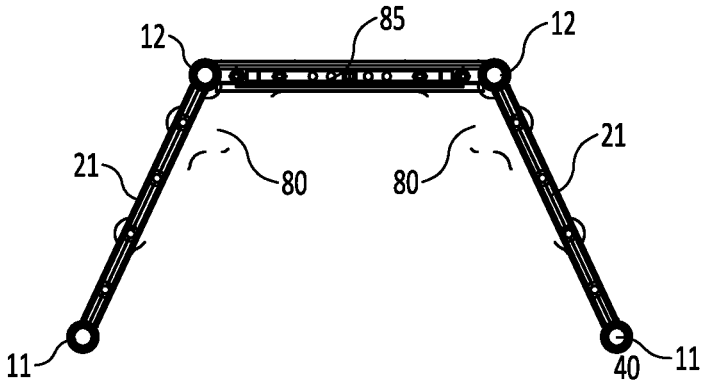
FIG. 6B shows a front view of the truss element of FIG. 6A.

FIGS. 6A and 6B show an example of a truss element with a trapezoid cross-sectional shape which is imparted by correspondingly shaped coupling elements 80, making use of the same or similar ladder elements 10 as applied in the preceding embodiments. The coupling elements 80 comprise guides 85 in which support devices 40 can if desired be received for additional stiffness on the short side. Owing to the open trapezium shape, the truss elements of this embodiment are nestable in particularly practical manner. If desired, a closed trapezium shape can however also be realized by closing the coupling elements 80 on the underside.

Figure 7A:
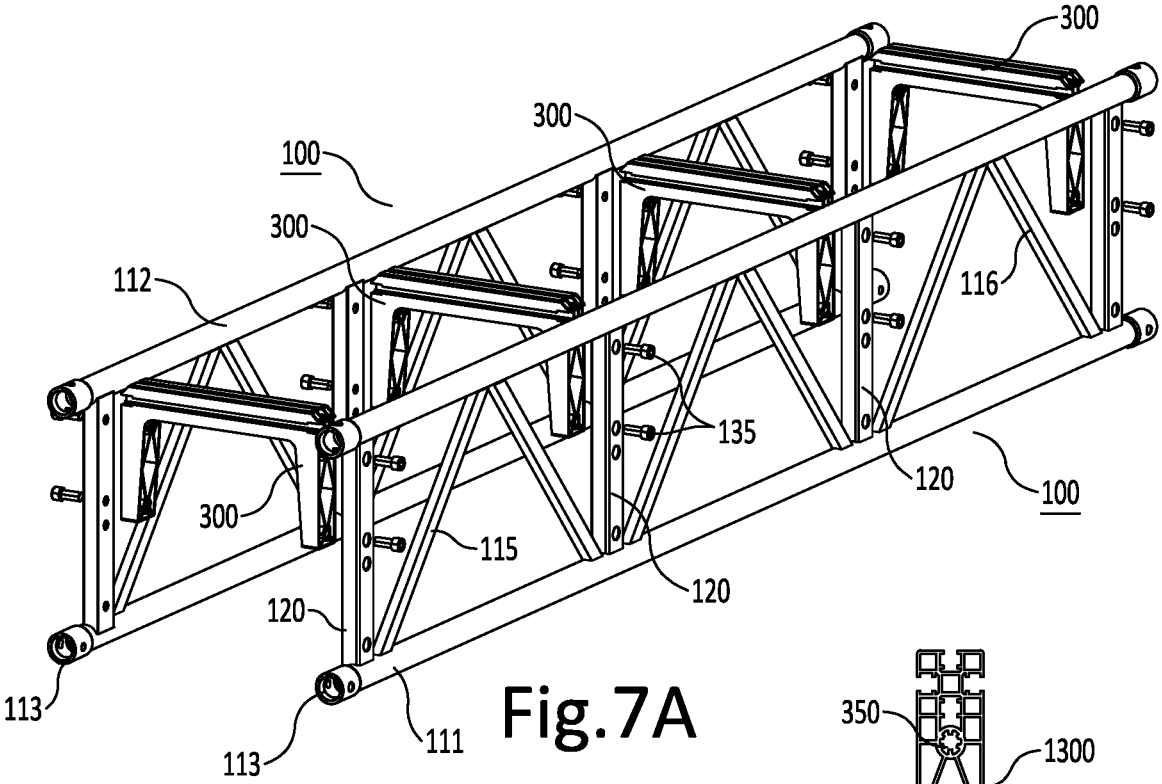
FIG. 7A shows a perspective view of the truss element of a second embodiment of a truss element according to the invention.
Figure 7C:
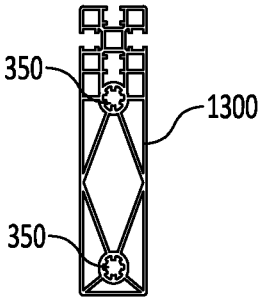
FIG. 7C shows a cross-section through the coupling element as applied in the truss element of FIG. 7A.
Figure 7B:
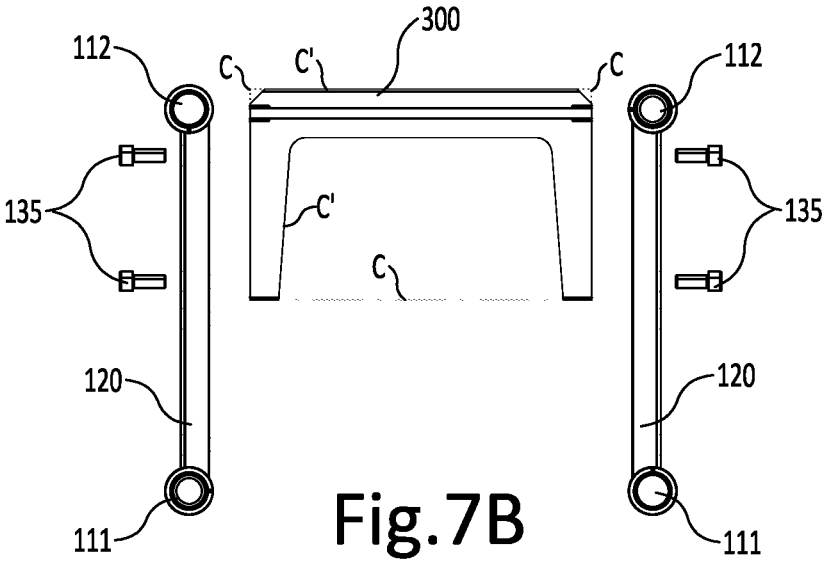
FIG. 7B shows a front view of the truss element of FIG. 7A.

A particularly practical and versatile sixth embodiment of the truss element according to the invention is shown in FIGS. 7A-7C. Use is here once again made of a set of ladder elements 100 which are releasably coupled to each other by means of coupling elements 300 and which are provided at their outer ends with coupling means 113 for force-transmitting coupling to for instance a further, similar truss element. The ladder elements 100 comprise between a first tube body 111 and a second tube body 112 a system of shores 115, 116 which provide an additional bond, strength and stability thereto.

The ladder elements 100 are provided at a regular pitch with coupling devices 120 in the form of transverse beams 120. The transverse beams comprise drilled holes 125 for receiving screw bolts 135 which are received in corresponding screw holes 350 in the coupling element 300 and enter directly into a firm although releasable screw connection therewith, or are received in separate nut bodies which were arranged in the coupling element 300, particularly transversely of and through a screw hole 350. For the transverse beams 120 use can be made of solid parts or hollow tubular parts, preferably of the same material as the other parts of ladder elements 110, such as for instance aluminium, stainless steel or optionally preserved steel or (fibre-reinforced) plastic.

In this case the coupling element 300 are formed from a uniform extruded body 1300, a cross-section of which is shown in FIG. 7C and an initial contour C of which is shown in FIG. 7B. A coupling element 300 can be removed therefrom along a specific desired contour C' by machining, sawing or (laser) cutting the extruded body correspondingly. In the example use is thus made of U-shaped connecting bodies 300 with a view to a U-shaped truss, similar to that of FIG. 4A. By applying a set thereof in mirrored manner a truss similar to that of FIGS. 2A and 5A with a square, at least rectangular cross-section can however also be formed if desired, and other polygonal coupling elements can also be removed from the extruded profile, such as for instance a triangular or trapezoidal coupling element similar to that of the embodiments of FIGS. 3A and 6A. It will therefore be apparent that such a or a similar extruded body 1300, see FIG. 7C, provides a particularly great deal of flexibility and versatility for a truss element according to the invention to be realized, using the same or at least similar ladder elements.

Although the invention has been further elucidated above with reference to only a limited number of embodiments, it will be apparent that the invention is by no means limited thereto. On the contrary, many variations and embodiments are still possible within the scope of the invention for a person with ordinary skill in the art. Besides the shown polygonal shapes other polygons can thus also be realized, both form-closed and open on one or more sides. The indicated dimensions and length-height-width ratios are given solely by way of illustration and can be varied as desired. Other couplings can also be opted for for the truss couplings at the free outer ends of the tube elements in order to connect to a differing, optionally already existing coupling system. Instead of bolt-nut or bolt-threaded cavity connections, self-tapping screws can in some cases be opted for.

All in all, with a unique and innovative truss element the invention provides a modular truss system which is wholly detachable to the level of the coupling elements, ladder elements and optional support devices applied therein, and can thereby be utilized in many forms and embodiments using the same components.

The invention claimed is:

1. A truss element comprising at least a first and a second ladder element of mutually parallel tube bodies extending in a longitudinal direction, the tube bodies of which are mutually connected by a system of shores and are provided at opposite outer ends with coupling means for a releasable, force-transmitting coupling to a further truss element, wherein the ladder elements are mutually connected in transverse direction by means of a number of form-stiff coupling elements which impart a shape to the truss element, wherein the ladder elements comprise connecting means for a releasable connection to a flank of a coupling element, and wherein the ladder elements are connected rigidly to each other via the coupling elements by means of the connecting means.

2. The truss element according to claim 1, wherein the connecting means lie wholly between the tube bodies of the ladder element in question.

3. The truss element according to claim 1, wherein the coupling elements impart an at least substantially polygonal cross-section with opposite polygon sides to the truss element, particularly a polygonal cross-section from a group comprising a triangle, a square, a rectangle and a trapezium, and wherein the coupling elements comprise complementary connecting means on opposite polygon sides of the polygonal cross-section for the releasable connection to the connecting means of the adjacent ladder element.

4. The truss element according to claim 1, wherein at least a part of the coupling elements between the ladder elements are connected releasably in the longitudinal direction via one or more strengthening devices.

5. The truss element according to claim 4, wherein the strengthening devices each comprise at least one diagonal, particularly a shoring cross, between a set of opposite transverse ribs and that outermost transverse ribs are connected releasably to an adjacent coupling element.

6. The truss element according to claim 5, wherein the outermost transverse ribs and the coupling elements comprise in corresponding manner an axial guide and a guide body sliding therein, which guide body is locked in the guide in the longitudinal direction, and wherein provided between the guide and the guide body locked therein are releasable connecting means which fix the guide body in the guide.

7. The truss element according to claim 6, wherein the guide body comprises a strip part and the guide an axial receiving cavity in which the strip part can be fittingly received.

8. The truss element according to claim 1, wherein the shores are in each case flanked on either side by a releasable connection to a coupling element.

9. The truss element according to claim 1, wherein the connecting means inside each of the ladder elements in each case comprise alternately with the shores a set of ribs which leave a mutual recess in which a flank of a coupling device can be received and releasably connected.

10. The truss element according to claim 9, wherein the ribs and the coupling element are provided in corresponding manner with at least one screw cavity and a screw member fitting therein for the purpose of a releasable connection.

11. The truss element according to claim 1, wherein the coupling elements each comprise a monolithic body.

12. A ladder element for application in the truss element according to claim 1, comprising a set of mutually parallel tube bodies which extend in a longitudinal direction and are mutually connected by a set of shores, wherein coupling means are provided on opposite free outer ends thereof for the purpose of a releasable, force-transmitting coupling to a further truss element, wherein connecting means are provided therein for the purpose of a releasable connection to a flank of a coupling element which is able and configured to bring about and maintain a releasable connection in transverse direction to a spatially separated further ladder element which likewise extends in the longitudinal direction.

13. A coupling element for application in the truss element according to claim 1, comprising a form-stiff, monolithic metal body which is particularly obtained by extrusion and which imparts a polygonal cross-section to the truss element, and which is provided on opposite polygon sides with connecting means for a releasable connection to a ladder element of the truss element.

14. A truss system comprising one or more mutually connected truss elements of the type according to claim 1.

15. The truss element according to claim 3, wherein the connecting means comprise drilled holes for receiving screw members for a screw connection to a ladder element.

16. The truss element according to claim 5, wherein the outermost transverse ribs are connected releasably to an adjacent coupling element by means of a releasable screw connection.

17. The truss element according to claim 6, wherein the releasable connecting means comprise a bolt-nut connection by means of mutually registering drilled holes provided for this purpose in the guide and the guide body.

18. The truss element according to preceding claim 11, wherein the monolithic body comprises an extruded body.

19. The truss element according to preceding claim 11, wherein the monolithic body comprises a metal body.

20. The coupling element according to claim 13, wherein the connecting means comprise drilled holes for receiving screw members for a screw connection to a coupling device.

* * * * *